US007258089B2

(12) United States Patent
Murata

(10) Patent No.: US 7,258,089 B2
(45) Date of Patent: Aug. 21, 2007

(54) VARIABLE VALVE UNIT FOR VEE SHAPE ENGINE

(75) Inventor: Shinichi Murata, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 136 days.

(21) Appl. No.: 11/103,509

(22) Filed: Apr. 12, 2005

(65) Prior Publication Data

US 2005/0279303 A1 Dec. 22, 2005

(30) Foreign Application Priority Data

Apr. 13, 2004 (JP) ..... 2004-117815

(51) Int. Cl.
*F01L 1/34* (2006.01)

(52) U.S. Cl. ..... 123/90.16; 123/90.31; 123/90.39

(58) Field of Classification Search ..... 123/90.16, 123/90.2, 90.39, 90.41, 90.44, 90.27, 90.31
See application file for complete search history.

(56) References Cited

U.S. PATENT DOCUMENTS 4,674,452 A * 6/1987 Asanomi ..... 123/90.31

5,992,361 A * 11/1999 Murata et al. ..... 123/90.17

FOREIGN PATENT DOCUMENTS

JP 3245492 B2 10/2001

* cited by examiner

*Primary Examiner*—Ching Chang
(74) *Attorney, Agent, or Firm*—Birch, Stewart, Kolasch & Birch, LLP

(57) ABSTRACT

A rocker arm mechanism opens and closes an intake valve. The intake valve is driven by cam of a cam shaft. The rocker arm mechanism is provided in each of bank. The rocker arm mechanism has a structure which changes a phase of the intake valve while displacing a portion driven by the cam to a circumferential direction of the cam shaft. A structure provided with an inversion mechanism inverts a rotating direction of the camshaft of one bank with respect to a rotating direction of the camshaft of the other bank. A variable valve unit having the simple and same structure can be used in both banks. A phase is varied so that a valve closing timing is set larger than a valve opening timing for each bank.

9 Claims, 11 Drawing Sheets

VARIABLE VALVE UNIT FOR VEE SHAPE ENGINE

CROSS-REFERENCE TO RELATED APPLICATIONS

This application is based upon and claims the benefit of priority from prior Japanese Patent Application No. 2004-117815, filed Apr. 13, 2004, the entire contents of which are incorporated herein by reference.

BACKGROUND OF THE INVENTION

1. Field of the Invention

The present invention relates to a variable valve unit for a V-type engine, which can vary a drive phase of an intake or exhaust value.

2. Description of the Related Art

Most engines built for automobiles are equipped with a variable valve unit to restrict exhaust gas of engine and to reduce fuel consumption (gas mileage). The variable valve unit changes a phase, that is, opening and closing timing of intake/exhaust valve in accordance with driving mode of automobiles.

A reciprocating cam structure is given as the structure of the variable valve unit. According to the reciprocating cam structure, a phase of cam formed in a camshaft is temporarily replaced with a reciprocating cam. The reciprocating cam has a base circle interval and a lift interval, which communicate with each other.

In this kind of reciprocating cam structure, a rocker arm mechanism is often used to vary a ratio of a base circle interval and a lift interval replaced with the reciprocating cam. The rocker arm mechanism changes the foregoing ratio in accordance with driving mode of automobiles. For example, Japanese Patent No. 3245492 discloses the variable valve unit described above.

On the other hand, in the engine, a reduction of pumping loss is required in order to achieve a reduction of fuel consumption.

If the foregoing reduction of pumping loss is taken into consideration, the following condition should be satisfied. Specifically, when changing a phase of an intake valve, it is desirable to vary the phase, that is, valve opening and closing timing while constantly maintaining the valve opening timing of the intake valve. By doing so, intake air is supplied to cylinders without loss.

BRIEF SUMMARY OF THE INVENTION

An aspect of the present invention is to provide a variable valve unit for a V-type engine, which is used in common to each bank, and can largely vary a valve closing timing rather than a valve opening timing with the same phase variable in each bank.

According to the present invention, a variable valve unit for a V-type engine includes, a camshaft, a rocker arm mechanism, and an inversion mechanism.

The camshaft is attached to each of a pair of banks.

The rocker arm mechanism opens and closes at least one of an intake valve and exhaust valve. The rocker arm mechanism is driven by the cam formed in the camshaft. The rocker arm mechanism changes a phase of the intake valve or the exhaust valve while displacing a position driven by the cam to a circumferential direction of the camshaft.

The inversion mechanism inverts a rotating direction of a camshaft of one bank with respect to a rotating direction of a camshaft of the other bank.

The foregoing structure is given, and thereby, a variable valve unit having the simple and same structure is used in common to each bank using the foregoing inversion of the rotating direction of the camshaft. In each bank, the valve closing timing is varied larger than the valve opening timing with the same cam phase variable, and thereby, pumping loss is reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

The variable valve unit for a V-type engine according to a first embodiment of the present invention will be described below with reference to FIG. 1 to FIG. 12.

Figure 1:
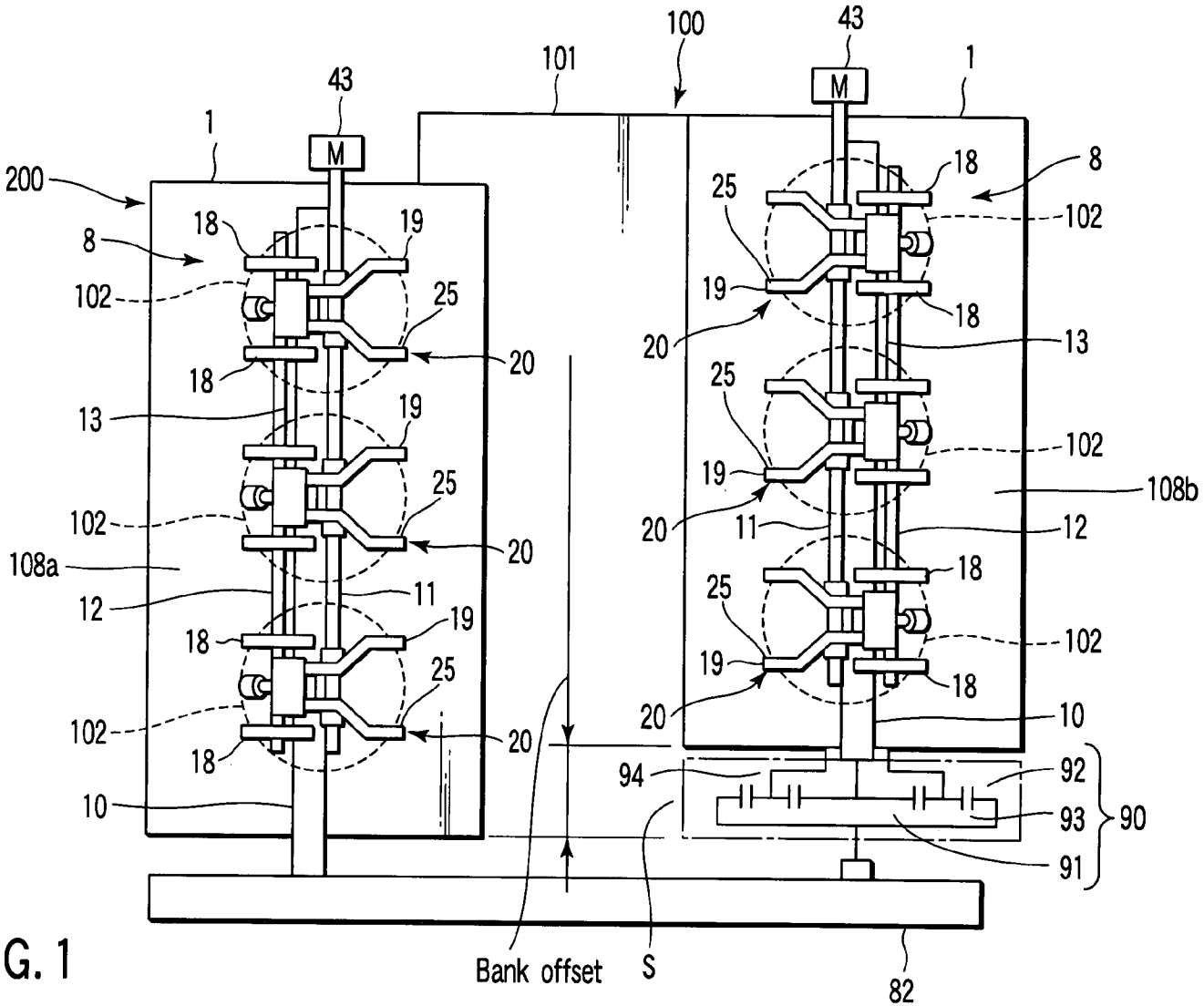
FIG. 1 is a top plan view showing a variable valve unit according to a first embodiment of the present invention together with an SOHC type V-type engine head attached with the same unit.
Figure 2:
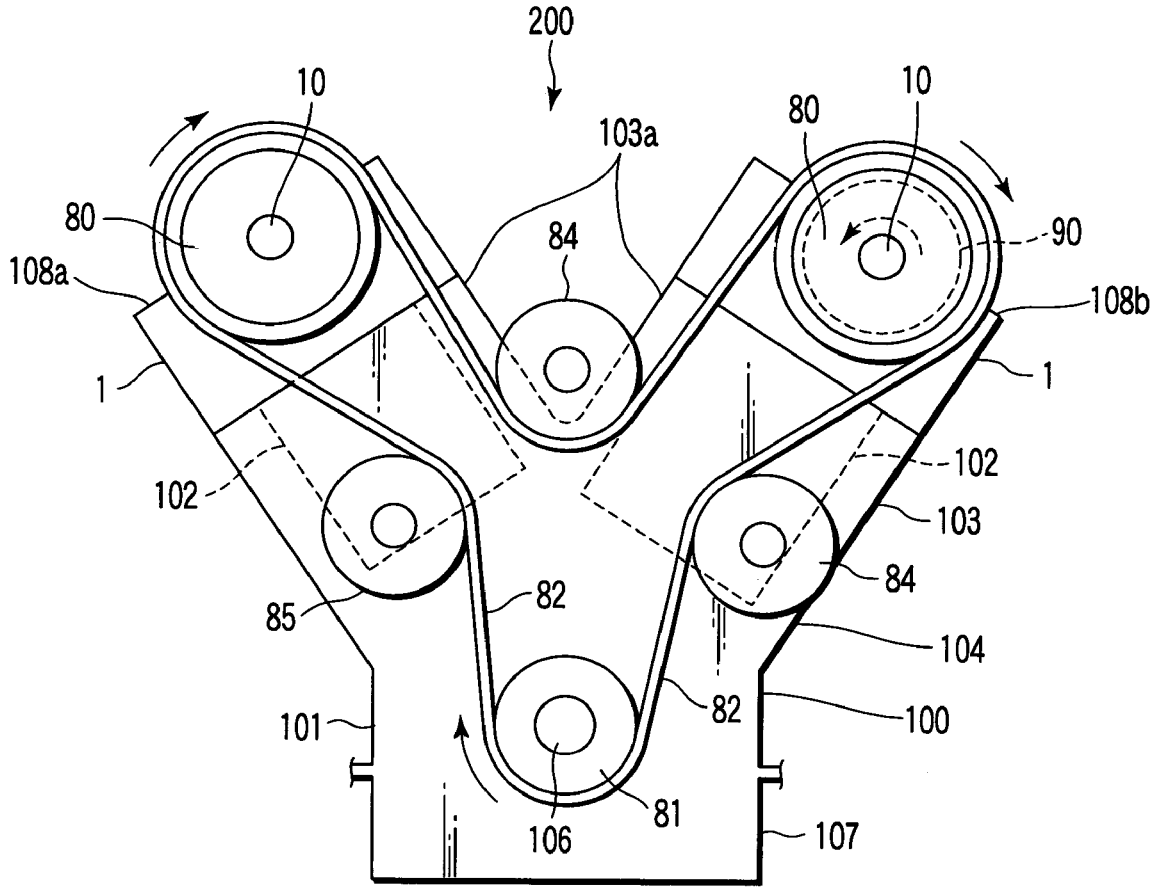
FIG. 2 is a front view showing a V-type engine shown in FIG. 1.
Figure 3:
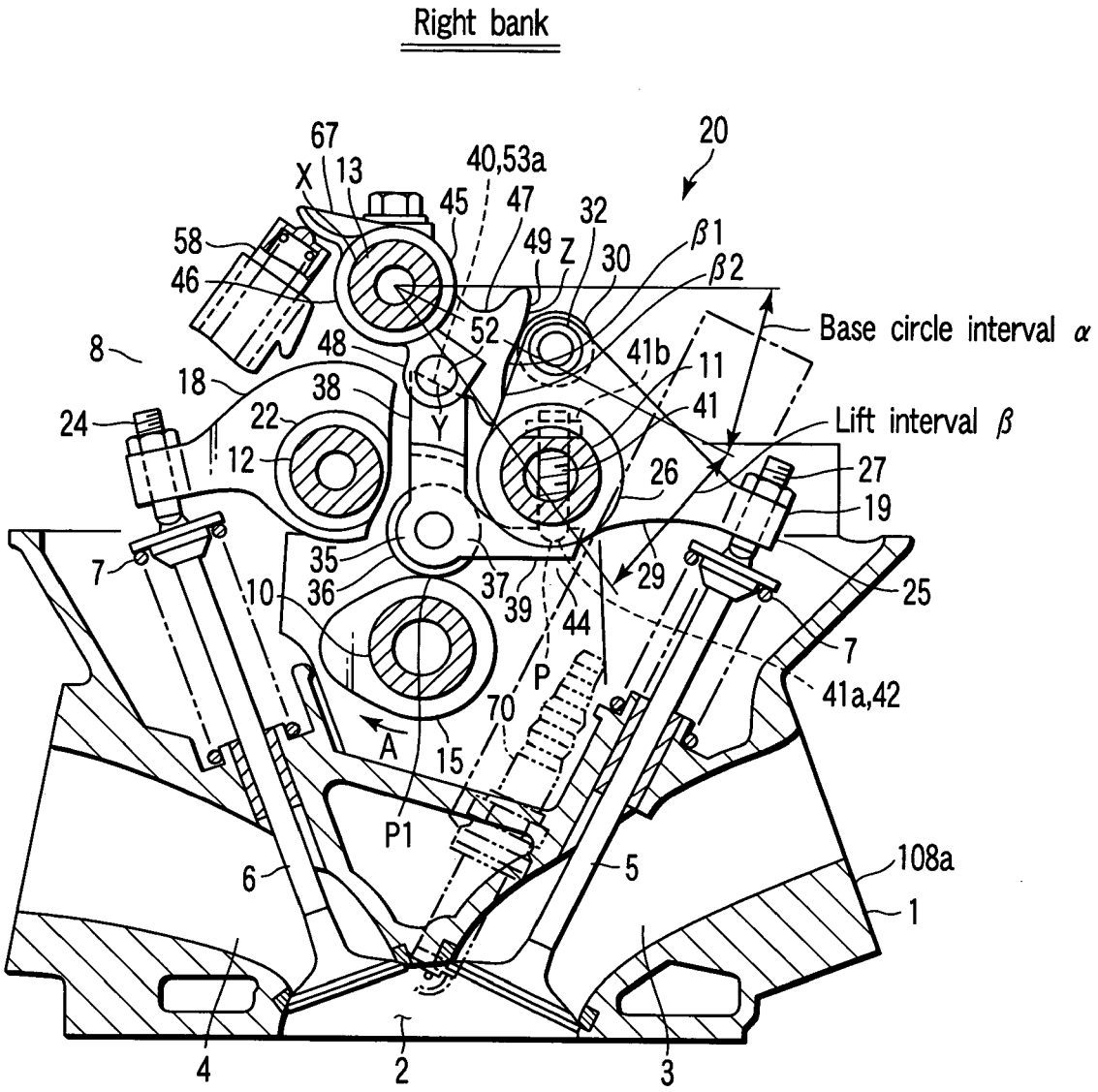
FIG. 3 is a cross-sectional view showing a variable valve unit attached to a right bank of the V-type engine shown in FIG. 1 in the vicinity of an intake cam.
Figure 4:
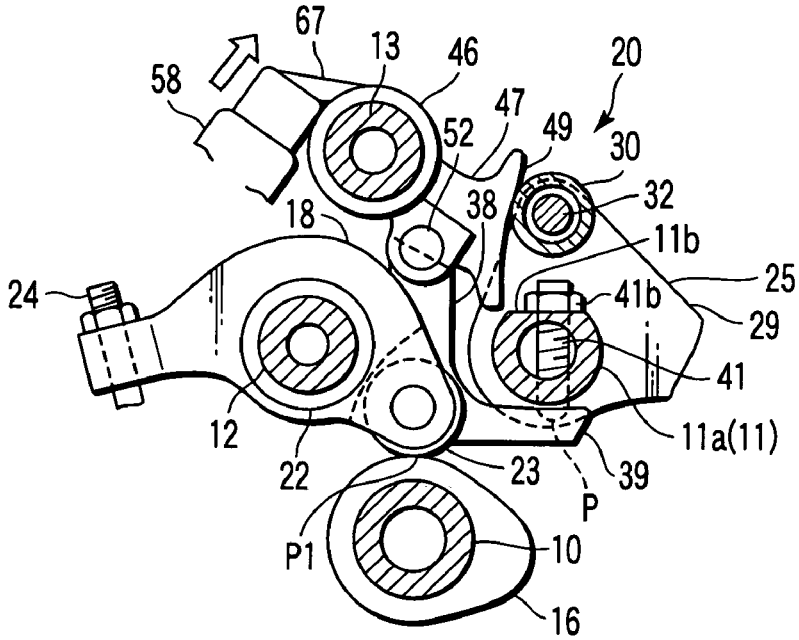
FIG. 4 is a cross-sectional view showing the variable valve unit attached to the right bank of the V-type engine shown in FIG. 1 in the vicinity of an exhaust cam.
Figure 7:
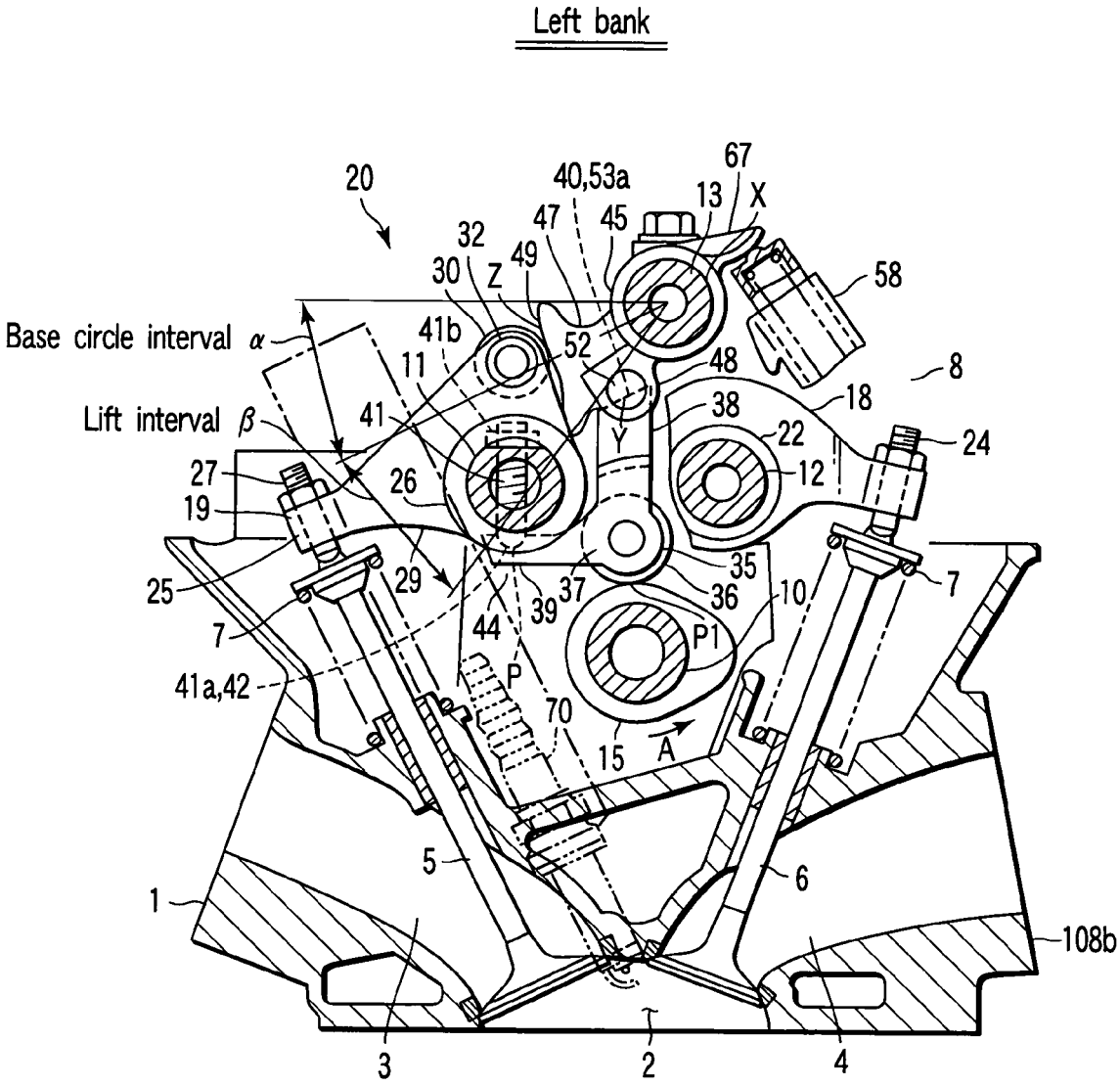
FIG. 7 is a cross-sectional view showing a variable valve unit attached to a left bank of the V-type engine shown in FIG. 1.

FIG. 1 is a top plan view showing a V-type engine 200. The engine 200 is a V shape six-cylinder reciprocating gasoline engine, for example. FIG. 2 is a front view showing the engine 200. FIG. 3 is a cross-section view showing a right bank of the engine 200. FIG. 4 is a cross-section view showing the right bank of the engine 200 at the point different from FIG. 3. FIG. 7 is a cross-section view showing a left bank of the engine 200.

As shown in FIG. 1 and FIG. 2, the engine 200 includes an engine main body 100. The engine main body 100 includes cylinder block 104, cylinder head 1, oil pan 107, etc.

The cylinder block 104 has a crankcase portion 101 at the lower portion. The cylinder block 104 has a deck cylinder portion 103 at the upper portion. The deck cylinder portion 103 is provided with six cylinders 102. These cylinders are divided three by three. Thus, the deck cylinder portion 103 has a V-shape.

The cylinder head 1 is attached to each head 103*a* of the deck cylinder portion 103. The oil pan 107 is attached to the cylinder block 104 to cover a lower opening portion of a crankcase portion 101.

The foregoing structure is given, and thereby, the engine main body 100 includes right bank 108*a* and left bank 108*b*. The right and left banks 108*a* and 108*b* are composed of the deck cylinder portion 103 and the cylinder head 1.

In this case, cylinders attached to banks 108*a* and 108*b* are arranged in a mutually shifted state so that a connecting rod extending from a piston reciprocating received in each cylinder 102 is arranged on the axis of a crankshaft 106.

As illustrated in FIG. 3 and FIG. 7, the cylinder head 1 attached to the right bank 108*a* is formed with several combustion chambers 2 at the lower portion. Each combustion chamber 2 is formed correspondingly to the cylinder 102. The cylinder head 1 attached to the left bank 108*b* is formed with several combustion chambers 2 at the lower portion. Each combustion chamber 2 is formed correspondingly to the cylinder 102.

Each cylinder head 1 is provided with a pair of intake ports 3 and a pair of exhaust ports 4 for each combustion chamber 2. In FIG. 3 and FIG. 7, only one side of the foregoing intake and exhaust ports 3 and 4 is shown.

Intake valve 5 and exhaust valve 6 are built in the upper portion of the cylinder head 1. The intake valve 5 opens and closes the intake port 3. The intake valve 5 comprises a reciprocating valve. The exhaust valve 6 opens and closes the exhaust port 4. The exhaust valve 6 comprises a reciprocating valve.

The foregoing intake port and valve 3 and 5 are arranged inside the bank in right and left banks 108*a* and 108*b*. The foregoing exhaust port and valve 4 and 6 are arranged outside the bank in right and left banks 108*a* and 108*b*.

Thus, the engine 200 supplies intake air from the inside of the bank, and discharges exhaust gas from the outside of the bank. As a result, the engine 200 rationally carries out intake and exhaust operations using a V-shape of the deck.

In this case, the foregoing intake and exhaust valves 5 and 6 are each a normally closed type urged to the valve closing direction by a valve spring 7.

The right and left banks 108*a* and 108*b* are provided with a valve system 8. The valve system 8 is a SOHC (single overhead camshaft) type.

The valve systems 8 attached to the right and left banks 108*a* and 108*b* are arranged in a state of being symmetrical with each other. Specifically, the structure in which intake port and valve 3 and 5, exhaust port and valve 4 and 6 are arranged in the right bank 108*a* is symmetrical with the structure in which intake port and valve 3 and 5, exhaust port and valve 4 and 6 are arranged in the left bank 108*b*.

Figure 5:
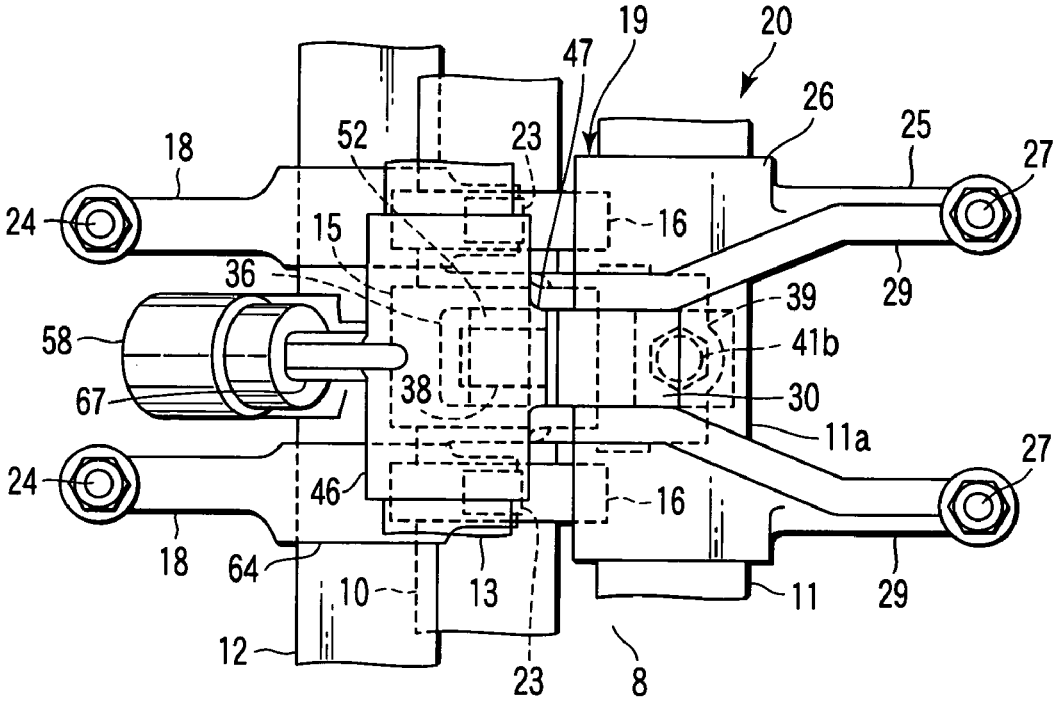
FIG. 5 is top plan view showing the variable valve unit shown in FIG. 1.
Figure 6:
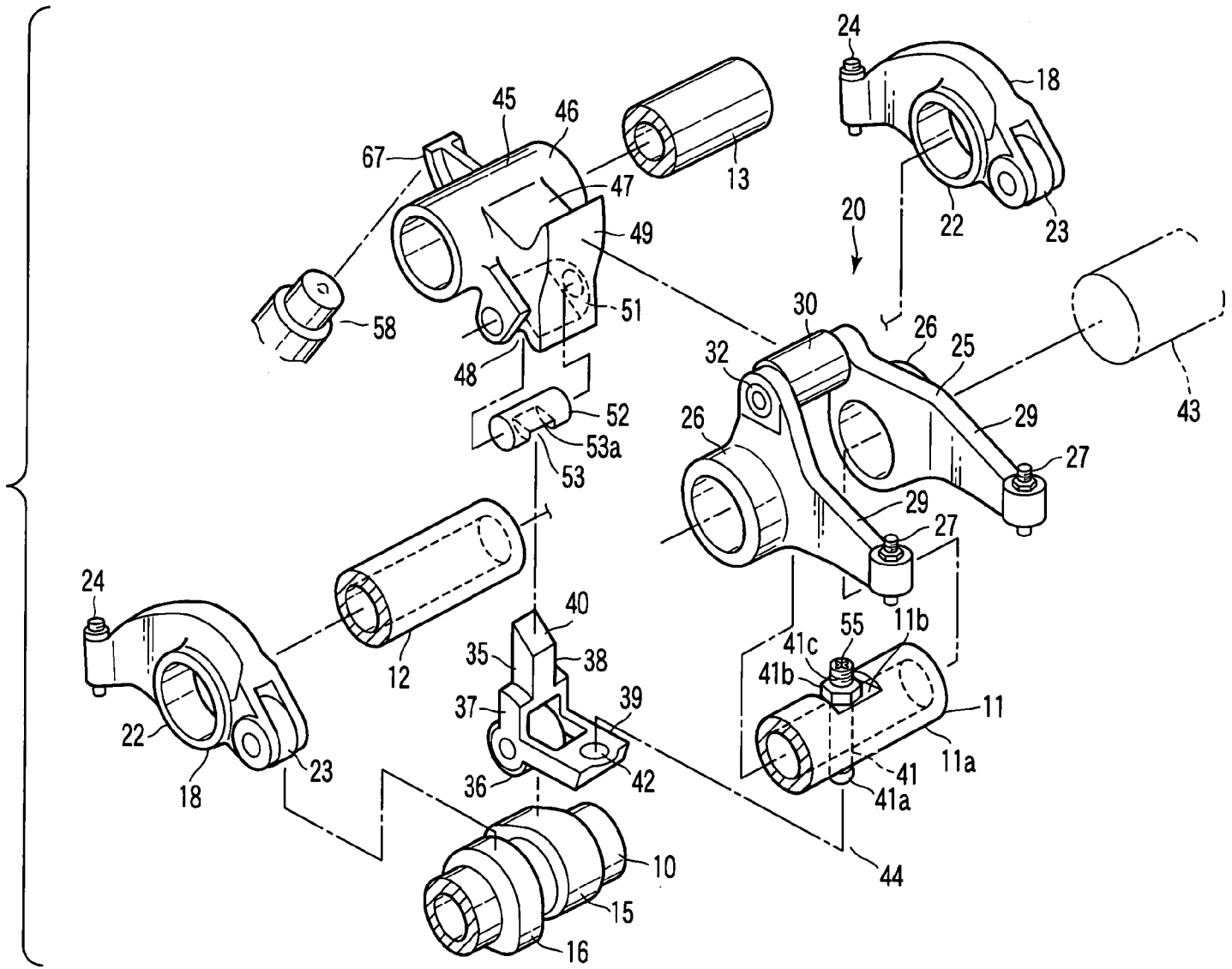
FIG. 6 is an exploded perspective view showing the variable valve unit shown in FIG. 5.

In the structure of the valve system 8 attached to the right banks 108*a* and structure of the valve system 8 attached to the left banks 108*b*, the same components and structure are employed. FIG. 5 is a top plan view showing a portion corresponding to one cylinder 102 in the valve system 8 attached to the right bank 108*a*. FIG. 6 is an exploded perspective showing a portion corresponding to one cylinder 102 in the valve system 8 attached to the right bank 108*a*.

The valve system 8 attached to the right bank 108*a* will be explained below. The valve system 8 includes camshaft 10, variable valve unit 20, exhaust rocker shaft 12 and rocker arm 18.

The camshaft 10 is arranged above the combustion chamber 2. The camshaft 10 extends along the longitudinal direction of the cylinder head 1. The camshaft 10 is rotatable.

As depicted in FIG. 3, when driven, the camshaft is rotated in a direction shown by an arrow A. The camshaft 10 is formed with one intake cam 15 and two exhaust cams 16 for each combustion chamber 2. Specifically, the intake cam 15 is formed at a shaft portion as seen in FIG. 5. The shaft portion is a portion corresponding to the center of the combustion chamber 2 in the camshaft 10. The exhaust cams 16 are arranged on both sides of the intake cam 15 in the camshaft 10.

The variable valve unit 20 includes a rocker arm mechanism 19. The rocker arm mechanism 19 includes intake rocker shaft 11 and support shaft 13.

The intake rocker shaft 11 is arranged inside of the bank. The rocker shaft 11 extends approximately parallel with the camshaft 10. The rocker shaft 11 is rotatable. The inside of the bank implies the inside in the widthwise direction of the cylinder head.

The exhaust rocker shaft 12 is arranged on the side opposite to the intake rocker shaft 11 via the camshaft 10, and fixed approximately parallel with the camshaft 10.

The support shaft 13 is arranged fixed above between the rocker shafts 11 and 12. The support shaft 13 is fixed in a state of being arranged approximately parallel with the camshaft 10.

As shown in FIG. 4 to FIG. 6, the exhaust rocker shaft 12 is provided rotatably with the rocker arm 18 for each exhaust valve 6. The rocker arm 18 drives the exhaust valve 6. The exhaust rocker shaft 12 is provided for each exhaust valve 6, that is, exhaust cam 16. In FIG. 4 to FIG. 6, one-side rocker arm 18 is shown.

The rocker arm 18 includes rocker shaft support boss 22, roller member 23 and adjust screw portion 24, for example.

The rocker shaft support boss 22 is rotatably supported by the rocker shaft 12.

The roller member 23 is provided at one end of the rocker arm 18 and makes contact with the camshaft 10. The roller member 23 is rotatably attached.

The adjust screw portion 24 is provided at the other end portion of the rocker arm 18. The adjust screw portion 24 functions as a drive part of the exhaust valve 6. The roller member 23 rolls in contact with a cam surface of the exhaust cam 16. The adjust screw portion 24 is arranged at the upper end portion of the exhaust valve 6. The upper end portion of the exhaust valve 6 projects from the upper portion of the cylinder head 1 to the outside. The upper end portion of the exhaust valve 6 is a valve stem end.

The rocker arm mechanism 19 includes rocker arm 25 as a first arm, center rocker arm 35 as a second arm and swing cam 45 as a third arm.

Thus, the rocker arm mechanism 19 drives the paired intake valves 5 together. When the intake cam 15 and the exhaust cam rotate, the intake valve 5 and the exhaust valve 6 are opened and closed by the intake mechanism 19 and the rocker arm 18 according to a predetermined combustion cycle. The predetermined combustion cycle is, for example, four cycles, that is, intake stroke, compression stroke, expansion stroke and exhaust stroke, which successively continue.

As seen in FIG. 3 to FIG. 6, the rocker arm mechanism 19 includes the rocker arm 25 as a first arm, center rocker arm 35 as a second arm and swing cam 45 as a third arm.

The rocker arm 25 is swingably supported by the rocker shaft 11. The center rocker arm 35 is driven by the intake cam 15. The swing cam 45 is swingably supported by the support shaft 13.

As illustrated in FIG. 6, in the rocker arm 25, a portion transmitting displacement to several, that is, paired intake valves 5 is formed into a forked shape. For example, the rocker arm 25 includes a pair of rocker arm members 29. Each rocker arm member 29 is formed with a cylindrical rocker shaft support boss 26 at the center. The paired rocker arm members 29 are arranged in parallel with each other.

One end of the rocker arm member 29 is provided with an adjust screw portion 27. The adjust screw portion 27 is a drive part for driving the intake valve 5. A roller member 30 is rotatably interposed between the other ends of the rocker arm members 29 as a rolling contact element. The roller member 30 is rotatably supported by a short shaft 32.

As shown in FIG. 3 and FIG. 5, the rocker shaft 11 is inserted into the rocker shaft support boss 26 of the assembled rocker arm 25 so that the rocker arm 25 is swingable.

In this case, the roller member 30 is oriented to the center of the cylinder head 1. One adjust screw portion 27 is arranged at the upper end of one intake valve 5. The upper end of one intake valve 5 projects from the upper portion of the cylinder head 1. The other adjust screw portion 27 is arranged at the upper end of the other intake valve 5. The upper end of the other intake valve 5 projects from the upper portion of the cylinder head 1. The upper end of each intake valve is a valve stem end.

As depicted in FIG. 3 and FIG. 6, an L-letter shaped member is used as the center rocker arm 35. The center rocker arm 35 has cam follower 36 and holder portion 37, for example. The shape of holder portion 37 is frame shape for rotatably supporting the cam follower 36. The cam follower 36 is a rolling contact element, which rolls in contact with the cam surface of the intake cam 15.

The center rocker arm 35 has relay arm portion 38 and fulcrum arm portion 39. The relay arm portion 38 extends upwardly from the holder portion 37. The relay portion 38 has a pillar shape. Specifically, the relay arm portion 38 extends toward between the rocker shaft 11 and the support shaft 13.

As shown in FIG. 4, the fulcrum arm portion 39 has a flat shape extending from the side of the holder portion 37 to the lower side of a rocker shaft portion 11*a*. The rocker shaft portion 11*a* is a portion which expose from between one and the other rocker arm members 29.

The tip end of the relay arm portion 38 is formed with an inclined plane 40 as a drive surface for transmitting displacement to the swing cam 45. The inclined plane 40 is formed in a manner that the side of the rocker shaft 11 becomes lower while the side of the support shaft 13 becomes higher.

The foregoing structure is given, and thereby, the center rocker arm 35 is formed into an approximately L-letter shape.

The tip end of the fulcrum arm portion 39 is supported by the rocker shaft portion 11*a*. As seen in FIG. 3, FIG. 4, FIG. 6 and FIG. 8 to FIG. 11, the structure of supporting the fulcrum arm portion 39 to the rocker shaft portion ha is given using pin member 41 and lock nut 41*b*.

The pin member 41 is formed with a spherical portion 41*a* at the lower end portion. The pin member 41 is formed with an external thread portion 41*c* at the outer circumferential surface. The external thread portion 41*c* is formed with an external thread.

The upper portion of the rocker shaft portion ha is formed with a setting seat 11*b*. The setting seat 11*b* is formed in a manner that the upper portion of the rocker shaft portion ha is notched. The pin member 41 penetrates downwardly through the rocker shaft portion ha from the setting seat 11*b*.

In the rocker shaft portion 11*a*, a hole through which the pin member 41 penetrates is formed with an internal thread portion engaging with the external thread portion 41*c*. By doing so, the pin member 41 is screwed into the rocker shaft portion 11*a*. The lock nut 41*b* clamps a portion projected from the setting seat 11*b* in the pin member 41. Thus, the pin member 41 is fixed to the rocker shaft portion 11*a*.

The end portion of the pin member 41 projected from the rocker shaft portion ha is supported via the fulcrum arm portion 39. The fulcrum arm portion 39 is formed with a semi-spherical receiver portion 42 at the upper surface of the tip end. A spherical portion 41*a* projecting from the rocker shaft portion 11*a* is rotatably fitted into the receiver portion 42.

The spherical portion 41*a* and the receiver portion 42 form a pivot portion P. The pivot portion P functions as the fulcrum of the side of the rocker shaft 11 of the center rocker arm 35.

When the intake cam 15 drives the cam follower 36, the center rocker arm 35 is vertically swingable with the pivot portion P where the spherical portion 41*a* is fitted into the receiver portion 42 as the fulcrum.

As depicted in FIG. 1 and FIG. 6, an end portion of the rocker shaft 11 is connected with a control actuator, that is, control motor 43. The control motor 43 is actuated, and thereby, the rocker shaft 11 is desirably rotated and displaced.

Figure 8:
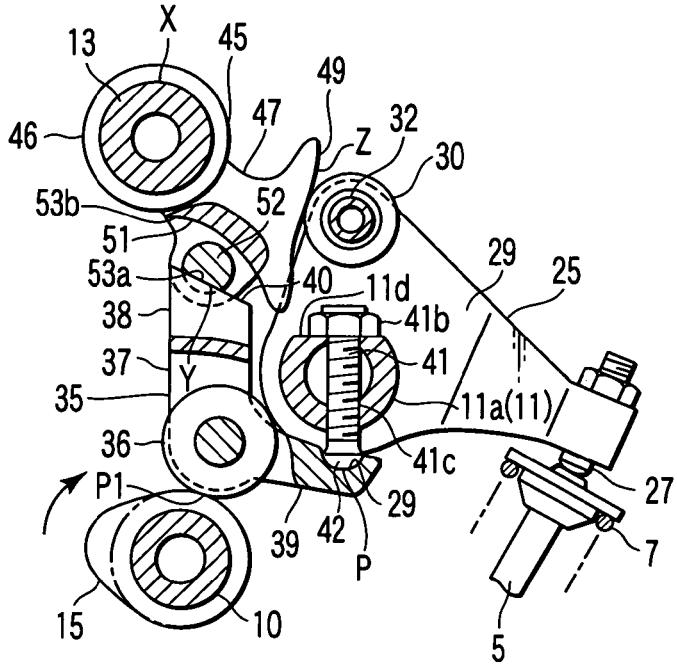
FIG. 8 is a cross-sectional view showing a state in which an abutting portion of a rocker arm is in contact with a base circle interval of a cam surface in the maximum valve lift control of the variable valve unit.
Figure 9:
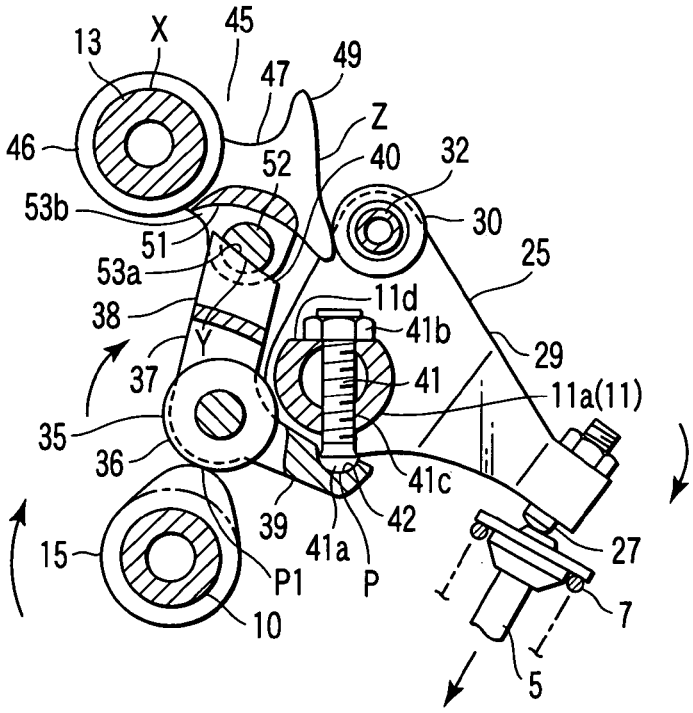
FIG. 9 is a cross-sectional view showing a state in which an abutting portion of a rocker arm is in contact with a lift interval of the cam surface shown in FIG. 8.
Figure 10:
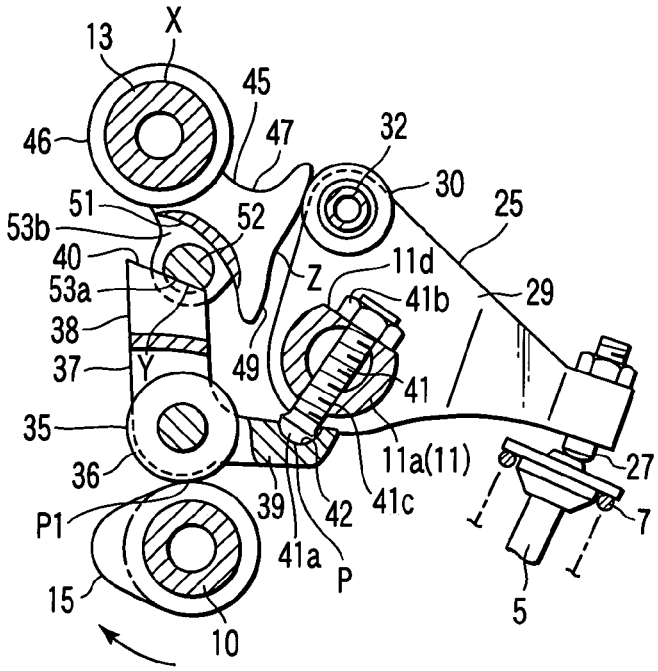
FIG. 10 is a cross-sectional view showing a state in which an abutting portion of a rocker arm is in contact with a base circle interval of a cam surface in the minimum valve lift control of the variable valve unit.
Figure 11:
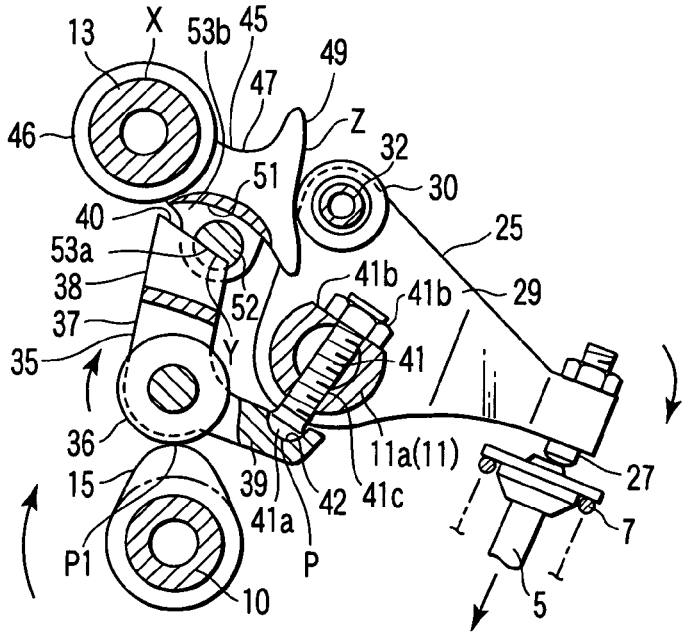
FIG. 11 is a cross-sectional view showing a state in which an abutting portion of a rocker arm is in contact with a lift interval of the cam surface shown in FIG. 10.

More specifically, the rocker shaft 11 is rotatable within a range described below. Namely, the rocker shaft 11 can be rotatable within a range from a state that the pin member 41 is approximately vertical as shown in FIG. 8 and FIG. 9 to a state that it is inclined to the camshaft 10 side as shown in FIG. 10 and FIG. 11.

The pivot support structure to the fulcrum arm portion of the pin member 41 and the control motor 43 form a fulcrum moving mechanism 44. The fulcrum moving mechanism 44 is one example of a variable mechanism.

The fulcrum moving mechanism 44 is used, and thereby, the fulcrum P of the rocker shaft 11 of the center rocker arm 35 is displaced to a direction crossing the axial direction of the rocker shaft 11.

As shown in FIG. 8 to FIG. 11, the fulcrum P of the rocker shaft 11 side of the center rocker arm 35 is moved, and thereby, the center rocker arm 35 is shifted in its position. By using the foregoing movement, a position P1 of the cam follower 36 rolling contact with the intake cam 15 is displaced in the circumference direction of the cam shaft 10.

As seen in FIG. 3, FIG. 4 and FIG. 6, the swing cam 45 has a displacement receiver portion 48. The support shaft 13 is rotatably inserted into the boss portion 46 so that the swing cam 45 is rotatable. The boss portion 46 has a cylinder shape.

The arm portion 47 extends from the boss portion 46 toward the roller member 30. Namely, the arm portion 47 extends from the boss portion 46 to the rocker arm 25. The displacement receiver portion 48 is formed at the lower portion of the arm portion 47.

The tip end of the arm portion 47 is formed with a cam surface 49. The cam surface 49 functions as a transmission surface portion for transmitting displacement to the rocker arm 25. The cam surface 49 extends vertically, for example. The cam surface 49 is rolled in contact with the outer peripheral surface of the roller member 30 of the rocker arm 25.

As illustrated in FIG. 6, the displacement receiver portion 48 has a recess portion 51 and a short shaft 52 as a shaft member. The recess portion 51 is formed at the lower portion of the arm portion 47 and just over the camshaft 10. The short shaft 52 is rotatably received in the recess portion 51 in the same direction as the shafts 10, 11 and 12.

The lower portion of the short shaft 52 exposing from the opening portion of the recess portion 51 is formed with a recess portion 53. The tip end of the relay arm portion 38, that is, the tip end of the center rocker arm 35 is slidably inserted into the recess portion 53.

The bottom of the recess portion 53 is formed with a receiver surface 53*a*. The receiver surface 53*a* is flat. The receiver surface 53*a* contacts with the inclined plane 40 to slidably receive the inclined plane 40.

The foregoing structure is given, and thereby, the swing cam 45 is periodically swingable when receiving the displacement of the center rocker arm 35 by swing. In this case, the support shaft 13 functions as the fulcrum X. The recess portion 53 functions as the effort point Y for receiving a load from the center rocker arm 35. The cam surface 49 functions as the load point Z for driving the rocker arm 25.

The center rocker arm 35 is driven by the intake cam 15. When the position of the center rocker arm 35 is displaced to the circumferential direction of the camshaft 10, the position of the swing cam 45 changes. When the position of the swing cam 45 changes, a phase of the intake cam 15 is shifted to advance or late angle direction.

The cam surface 49 has a curved surface. The distance from the center of the support shaft 13 to the curved surface changes. Specifically, the upper portion of the cam surface 49 is a base circle interval α. The lower portion of the cam surface 49 has a lift interval β as a conversion section.

The base circle interval α is an arc surface around the axis of the support shaft 13. The lift interval β has arc surfaces β1 and β2.

The arc surface β1 continues to the base circle interval α. The arc surface β1 is an arc surface reverse to the base circle interval α. The arc surfaces β2 continuing the arc surfaces β1 is an arc surface reverse to the arc surface β1.

The lift interval β is an arc surface having the same cam shape as the lift area of the intake cam 15. The lift interval β has the same function as the lift area of the intake cam 15.

When the cam follower 36 is displaced to the advance angle direction, the area of the cam surface 49 contacting with the roller member 30 changes.

Specifically, a ratio changes between intervals α1 and β3 given below. The interval α1 is an interval where the roller member 30 actually coming and going in the vase circle interval α. The interval β3 is an interval where the roller member 30 actually coming and going in the lift interval β.

With the change of the ratio of the intervals α1 and β3, in the opening and closing timing of the intake valve 5, the valve close timing is changed larger than the valve open timing. The valve open timing is continuously variable. Simultaneously, the quantity of the valve lift of the intake valve 5 is continuously variable.

As shown in FIG. 6, the upper end of the pin member 41 is formed with a plus-shaped groove 55 as a receiver member receiving a rotating operation, for example. The groove 55 of the pin member 41, the foregoing screw structure there and lock nut 41*b* are used, and thereby, the valve opening timing of the intake valve 5 is adjusted for each cylinder.

As seen in FIG. 3 to FIG. 6, the variable valve unit 20 is provided with pusher 58. The pusher 58 urges a lib-shaped receiver portion 67 formed at the outer circumferential portion of the boss portion 46. By doing so, the arms of the rocker arm mechanism 19 closely contacts with each other.

As depicted in FIG. 3, the cylinder head 1 is provided with an ignition plug 70. The ignition plug 70 ignites an air-fuel mixture in the combustion chamber 2. The ignition plug 70 is one example of devices for igniting an air-fuel mixture in the combustion chamber 2.

As illustrated in FIG. 7, the valve system 8 of the left bank 108*b* has a structure symmetrical with that of the right bank 108*a*. Specifically, components of the rocker arm mechanism 19 of the valve system 8 of the left bank 108*b* are arranged symmetrically with respect to the valve system of the right bank 108*a*.

Elements forming the variable valve unit 20 of the left bank 108*b* are the same as those forming the variable valve unit 20 of the right bank 108*a*. However, these elements forming the variable valve unit 20 of the left bank 108*b* are arranged in the direction reverse to those forming the right bank 108*a*.

The same reference numerals are used to designate elements forming the variable valve unit 20 of the right and left banks 108*a* and 108*b*. Thus, the explanation of the elements forming the variable valve unit 20 of the left bank 108*b* is omitted.

The variable valve unit 20 includes a pair of cam sprocket 80 and crankshaft sprocket 81. As seen in FIG. 2, one sprocket 80 is attached to one end of the camshaft 10 of the right bank 108*a*. The other sprocket 80 is attached to one end of the camshaft 10 of the left bank 108*b*.

The crankshaft sprocket 81 is attached to one end of the crankshaft 106. The cam sprocket 80 and the crankshaft sprocket 81 are stretched with a transmission member 82. A cock belt or chain is used as the transmission member 82. The transmission member 82 has a ring shape.

The transmission member 82 is part of a cam transmission mechanism. The output from the crankshaft 106 is transmitted to the camshafts of the right and left banks 10*a* and 108*b* via the cam transmission mechanism. Thus, the camshaft 10 is driven.

The engine main body 100 is provided with idler pulley 84 and tensioner pulley 85. The idler pulley 84 guides the transmission member 82. The tensioner pulley 85 gives tension to the transmission member 82.

As described above, the variable valve unit 20 of the right bank 108*a* is arranged symmetrically with that of the left bank 108*b*. The rotating directions of the camshafts 10 of the right and left banks 108*a* and 108*b* are the same.

Thus, if the crankshaft output is transmitted to the camshafts 10 of the right and left banks 108*a* and 108*b*, a cam phase change of the variable valve unit 20 of the left bank 108*b* becomes reverse to that of the variable valve unit 20 of the right bank 108*a*.

Thus, the variable valve unit 20 includes a planetary gear mechanism 90 as shown in FIG. 1 and FIG. 2. The planetary gear mechanism 90 is provided on the left bank 108*b*. The planetary gear mechanism 90 is one example of an inversion mechanism for inverting the rotation of the camshaft 10. The planetary gear mechanism 90 is used, and thereby, the phase change of the right and left banks 108*a* and 108*b* is made in the same direction.

The planetary gear mechanism 90 is received in an offset space S. The offset space S is a space formed by bank offset of the right and left banks 108*a* and 108*b*. Specifically, the offset space S is given between the front end of the left bank 108*b* and the cam sprocket 80 ahead the front end of the left bank 108*b*.

The planetary gear mechanism 90 is provided at the camshaft portion. In the camshaft 10, the camshaft portion is a portion between the cam sprocket 80 and the cam group nearest to the cam sprocket 80. The camshaft portion is divided into two, for example.

The planetary gear mechanism 90 is composed of sun gear 91, ring gear 92, planetary gear 93 and carrier 94. The sum gear 91 is connected to one of the two-divided camshaft portions. One of the two-divided camshaft portions is the side of the left bank 108*b*.

The ring gear 92 is connected to the other of the two-divided camshaft portions. The other of the two-divided camshaft portions is a pulley side.

The planetary gear 93 is engaged with the sun gear 91 and the ring gear 92.

A carrier 94 is fixed to the cylinder block 104. The carrier 94 supports the planetary gear 93.

Rotation inputted from the ring gear 92 is inverted in its rotating direction via the planetary gear 93. The rotation inverted via the planetary gear 93 is transmitted to the camshaft 10 of the right bank 108*a* via the sun gear 91.

The planetary gear mechanism 90 is used, and thereby, the phases of the intake valves of the right and left banks 108*a* and 108*b* are variable in the same direction.

The operation of each variable valve unit 20 of the right and left banks 108*a* and 108*b* will be explained below. When the engine 200 is driven, the output from the crankshaft 106 is transmitted to the right and left banks 108*a* and 108*b* via the transmission member 82.

First, the operation of the variable valve unit 20 of the right bank 108*a* will be explained below. As shown in FIG. 3, the camshaft 10 is rotated in the direction shown by an arrow A according to the output of the crankshaft 106 transmitted from the transmission member 82.

The cam follower 36 of the center rocker arm 35 contacts with the intake cam 15. The cam follower 36 is driven along a cam profile of the intake cam 15.

The center rocker arm 35 is vertically swingable with the pivot portion of the rocker shaft 11 as the fulcrum. The foregoing swing displacement is transmitted to the swing cam 45 over the center rocker arm 35.

One end portion of the swing cam 45 is swingably supported by the support shaft 13. The other end portion of the swing cam 45 is rolled in contact with the roller 30 of the rocker arm 25. The receiver surface 53*a* formed in the rotatable short shaft 52 contacts with the inclined plane 40 formed at the tip end of the relay arm 38.

By doing so, the swing cam 45 repeatedly ascends or descends by the inclined plane 40 while sliding on there. The swing cam 45 is swung, and thereby, the cam surface is vertically swingable.

The roller member 30 rolls in contact with the cam surface 49. Thus, the roller member 30 is periodically pressed against the cam surface 49. The roller member 30 is pressed against the cam surface 49, and thereby, the rocker arm 25 is driven with the rocker shaft 11 as the fulcrum. Therefore, several, that is, paired intake valve 5 is opened and closed at a time.

In running, by rotating the rocker shaft 11, the fulcrum position of the center rocker arm 35 is positioned on the place where the maximum valve lift is secured, for example.

In this case, the cam follower 36 of the center rocker arm 35 displaces on the cam surface of the intake cam 15. Then, the swing cam 45 is positioned in a state that the cam surface 49 is situated at an approximately perpendicular angle. The rocker shaft 11 is rotated by the control motor 43.

By doing so, the cam surface 49 is set to a position where the valve lift becomes the maximum.

Specifically, as shown in FIG. 8, the interval $\alpha 1$ where the roller member 30 actually reciprocates is set to the shortest distance in the base circle interval $\alpha$. The lift interval $\beta 3$ where the roller member 30 actually reciprocates is set to the longest distance in the lift interval $\beta$.

The intake valve 5 is opened and closed via the rocker arm 25, which drives between the intervals $\alpha 1$ and $\beta 3$ where the roller member 30 actually reciprocates. In this case, the valve lift of the intake valve 5 becomes the maximum as shown by the curve A1 in the graph of FIG. 12. The intake valve 5 is opened and closed at desired opening and closing timing.

On the other hand, as illustrated in FIG. 10 and FIG. 11, the rocker shaft 11 is rotated via the control motor 43 to vary the phase of the intake cam 15. Specifically, the rocker shaft 11 is rotated in the clockwise direction from the position where the maximum valve lift is secured. By doing so, the pivot portion of the center rocker arm 35, that is, the fulcrum position is shifted to the side of the rocker shaft 12.

In this case, the inclined plane 40 of the relay arm portion 38 contacts with the receiver surface 53*a* of the short shaft 52. The portion of the center rocker arm 35 contacting with the intake cam 15 is formed in the cam follower rolling in contact with the intake cam 15.

Thus, when the foregoing shift is transmitted to the center rocker arm 35, the position of the cam follower 36 rolling in contact with the cam 15 is shifted to the advance angle direction of the intake cam 15. The foregoing position is changed, and thereby, the valve opening timing of the varied cam phase wished to vary becomes early in accordance with the variable of the pivot portion, that is, the fulcrum position.

The inclined plane 40 displaces, that is, slides on the receiver surface 53*a* from the initial position to the advance angle direction by the foregoing shift of the fulcrum position. Thus, the swing cam 45 changes into a state that the cam surface 49 of the swing cam 45 is inclined to the lower side as illustrated in FIG. 10 and FIG. 11.

When the inclination of the cam surface 49 gradually becomes large, the interval α1 where the roller member 30 actually reciprocates gradually becomes long in the base circle interval α. On the other hand, the interval β3 where the roller member 30 actually reciprocates gradually becomes short in the lift interval β. Then, the cam profile of the cam surface 49 thus varied is transmitted to the roller member 30. Thus, the rocker arm 25 is swingably driven while making early the valve opening timing of the intake valve.

Even if the setting of the variable valve unit 20 changes between states that the valve lift of the intake valve 5 is the maximum and that it is the minimum, the opening timing of the intake valve 5 becomes substantially the same in each state. The closing timing is continuously varied and controlled.

Figure 12:
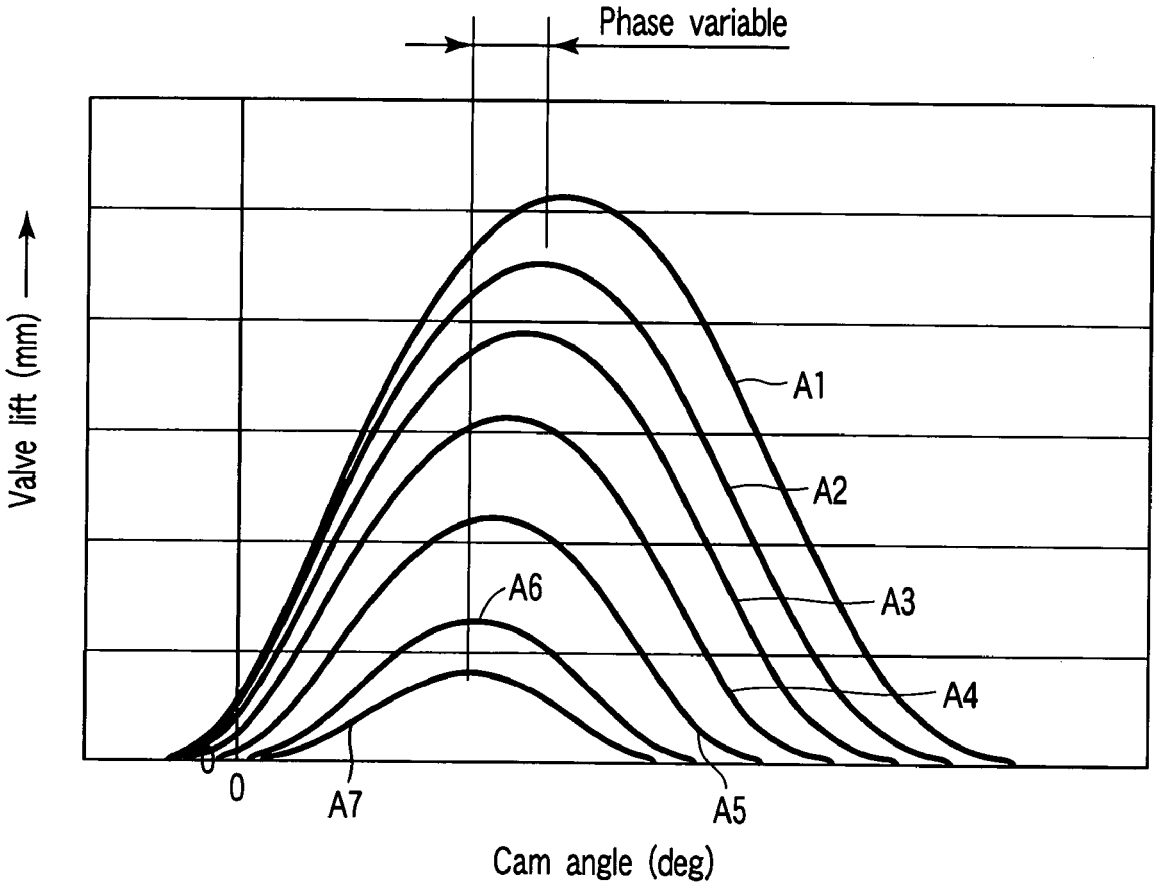
FIG. 12 is a graph to explain the performance of the variable valve unit.

The state that the valve lift of the intake valve 5 is the maximum is a state of A1 of FIG. 12. The state that the valve lift of the intake valve 5 is the minimum is a state of A7 of FIG. 12. In FIG. 12, A2 to A6 shows an intermediate state in the states from A1 to A7.

FIG. 10 and FIG. 11 show a state that the valve lift of the intake valve 5 is the minimum.

On the other hand, as depicted in FIG. 7, the rotation of the crankshaft 106 is inverted via the planetary gear mechanism 90, and thereafter, transmitted to the camshaft 10 of the left bank 108*b*.

As described above, the rotation of the crankshaft 106 is inverted and transmitted via the planetary gear mechanism 90. By doing so, the phase change direction of the variable valve unit 20 of the left bank 108*b* having the structure symmetrical to that of the right bank 108*a* is corrected.

In other words, the variable valve unit 20 of the left bank 108*b* having the structure symmetrical to that of the right bank 108*a* is driven via the intake cam 15 like the variable valve unit 20 of the right bank 108*b*. Then, the operation of varying the phase of the intake valve 5 of the left bank 108*b* is carried out.

Namely, the operation of varying the variable valve unit 20 of the left bank 108*b* is the same as the operation of varying the variable valve unit 20 of the right bank 108*b* shown in FIG. 8 to FIG. 11.

Thus, as seen in FIG. 12, each opening and closing timing of both intake valves 5 of the right and left banks 108*a* and 108*b* is continuously varied and controlled at the same timing from the state of A1 to the state of A7.

Therefore, the V-type engine 200 has the single variable valve unit 20 in common. In the right and left banks 108*a* and 108*b*, the same phase variable is secured while the valve closing timing is varied larger than the valve opening timing. Namely, the variable valve unit 20 is suitable to the V-type engine 200.

As a result, there is no phase difference between phase variable units in the right and left banks 108*a* and 108*b*. Therefore, the responsibility of the V-type engine 200 is improved.

Moreover, there is no need of providing a mechanism for compensating the phase difference between the right and left banks 108*a* and 108*b*. Therefore, the engine 200 is made compact. The controllability of the engine 200 is improved.

In particular, the planetary gear mechanism 90 is located in the space peculiar to the V-type engine 200, that is, offset space S. Thus, the planetary gear mechanism 90 is compactly built in the V-type engine 200. As a result, the V-type engine 200 is made compact.

In addition, the rocker arm mechanism 19 has the structure of displacing rocker arm 25, center rocker arm 35, each fulcrum position of the swing cam 45 and the center rocker arm 35. In other words, the rocker arm mechanism 19 has the structure in which the point driven by the intake cam 15 is displaced in the cam circumferential direction.

Thus, the cam phase is variable in a state that the valve opening timing is substantially the same, using the simple structure. In particular, the swing cam 45 is sued as the structure for simultaneously changing the valve opening and closing timing and the valve lift. Therefore, the structure for simultaneously changing the valve opening and closing timing and the valve lift is simple.

The second embodiment of the present invention will be explained below with reference to FIG. 13 and FIG. 14. According to the second embodiment, right and left banks 108*a* and 108*b* are provided with a DOHC-type (double overhead camshaft type) valve system 9. The DOHC-type valve system 9 has intake and exhaust sides, which are provided independently from each other. The valve system 9 includes intake and exhaust valve systems 9*a* and 9*b*.

According to the second embodiment, the exhaust valve system 9*b* includes exhaust camshaft 110, and rocker arm driven by a cam of the exhaust camshaft 110. The rocker arm opens and closes an exhaust valve. The intake valve system 9*a* includes intake camshaft 120 and the variable valve unit 20 described in the first embodiment.

The foregoing valve systems 9*a* and 9*b* are arranged in banks 108*a* and 108*b* in a state of being symmetrical with respect to the bank center. Specifically, the intake valve system 9*a* is arranged inside the bank. The exhaust valve system 9*b* is arranged outside the bank.

The exhaust camshaft 110 of the right bank 108*a* is provided with a cam sprocket 75. The intake camshaft 120 of the right bank 108*a* is provided with a cam sprocket 76. The cam sprockets 75 and 76 are connected to the crankshaft 106 via a transmission member 82. Thus, the output from the crankshaft 106 is transmitted to the foregoing exhaust and intake camshafts 110 and 120 via the transmission member 82 and the cam sprockets 75 and 76.

The exhaust camshaft 110 of the left bank 108*b* is provided with a cam sprocket 71. The cam sprocket 71 is connected to the crankshaft 106 via the transmission member 82. Thus, the output from the crankshaft 106 is transmitted to the exhaust camshaft 110 via the transmission member 82 and the cam sprocket 71.

According to the second embodiment, a gear mechanism 130 is provided as one example of the inversion mechanism. The gear mechanism 130 includes gears 130*a* and 130*b*. The gear 130*b* is attached to the exhaust camshaft 110. The gear 130*a* is attached to the intake camshaft 120 of the left bank 108*b*. The foregoing gears 130*a* and 130*b* are engaged with each other. Thus, when the exhaust camshaft 110 is rotated, the intake camshaft 120 is rotated via the gears 130*a* and 130*b*.

In this case, the rotation of the intake camshaft 120 is inverted to that of the exhaust camshaft 110. In other words, rotation reverse to the rotation of the exhaust camshaft 110 of the left bank 108*b* is transmitted to the intake camshaft 120 of the left bank 108*b*.

By doing so, even if the V-type engine 200 is provided with the DOHC-type valve system 9, it is possible to obtain the same effect as the -V-type engine 200 including the SOHC type valve system 8 described in the first embodiment.

The gear mechanism 130 is provided in an offset space S. Thus, the V-type engine 200 of the second embodiment is made compact.

Figure 13:
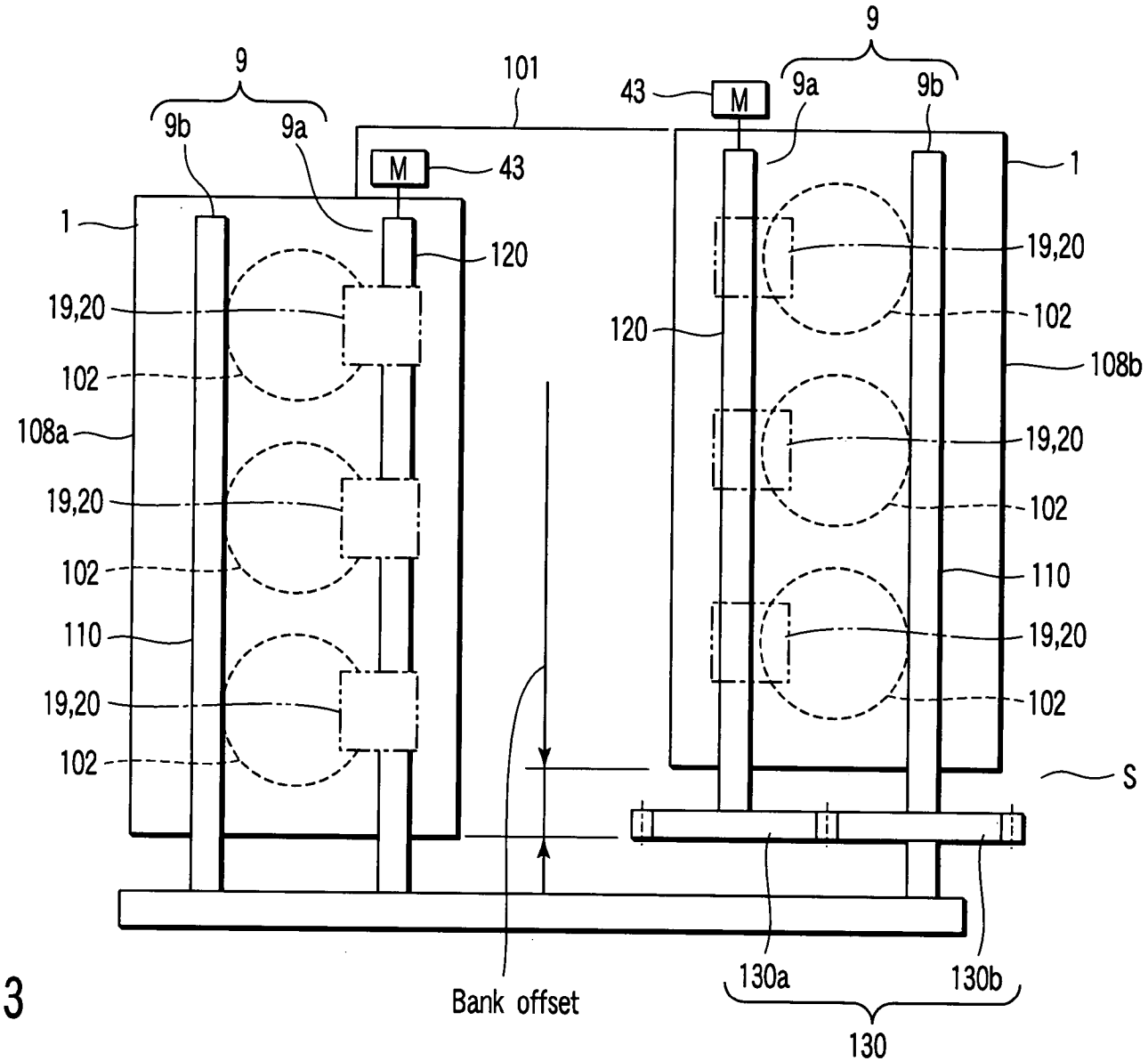
FIG. 13 is a top plan view showing a state wherein a variable valve unit according to a second embodiment of the present invention is attached to a DOHC-type V-type engine.
Figure 14:
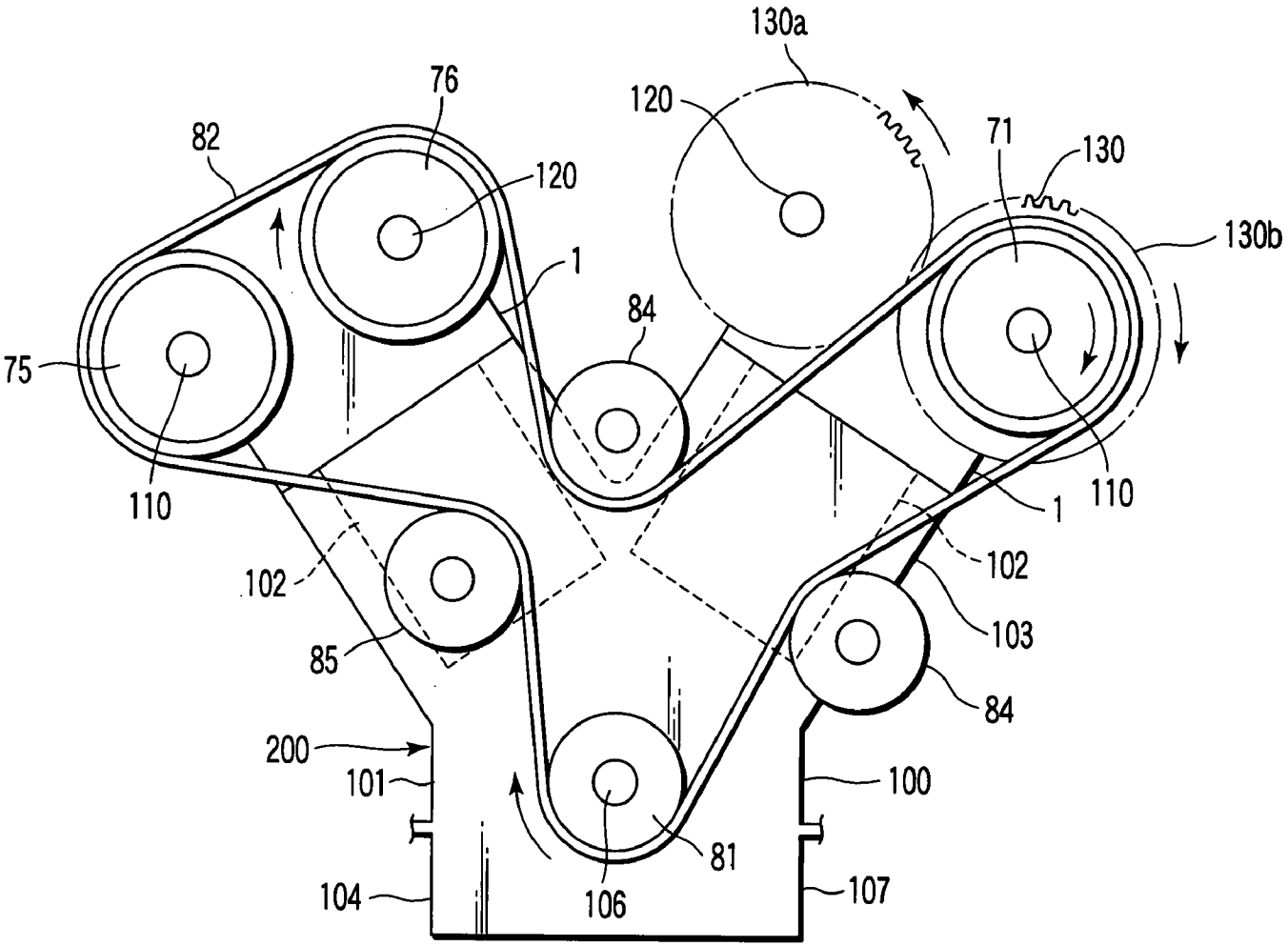
FIG. 14 is a front view showing a V-type engine shown in FIG. 13.

In FIG. 13 and FIG. 14, the same reference numerals are used to designate the same components as the first embodiment. The explanation about the portion provided with the reference numerals as the first embodiment is omitted.

The present invention is not limited to the foregoing first and second embodiments. Various changes may be made within the scope without diverging from the subject matter of the present invention.

For example, in the V-type engine equipped with the DOHC-type valve system, the variable valve unit is attached to the intake side only. However, the present invention is not limited to above. The variable valve unit may be attached to the exhaust side. The variable valve unit may be attached to both intake and exhaust sides. In this case, the inversion mechanism is used together.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A variable valve unit for a V-type engine, comprising:

a camshaft attached to each of a pair of banks, and formed with a cam;

a rocker arm mechanism opening and closing at least one of an intake valve and an exhaust valve, and driven by the cam formed in the camshaft, and adapted to change a phase of the intake valve or the exhaust valve while displacing a position driven by the cam to a circumferential direction of the camshaft; and an inversion mechanism inverting a rotating direction of a camshaft of one bank with respect to a rotating direction of a camshaft of the other bank, inversion mechanism being provided only at one end portion of the other bank.

2. A variable valve unit for a V-type engine according to claim 1, wherein said each bank is provided with a cylinder, said one and the other bank are mutually offset, and thereby, arranged in a state of being shifted, the inversion mechanism is provided in an offset space, which is formed at a bank end by offsetting the banks.

3. A variable valve unit for a V-type engine according to claim 2, wherein the rocker arm mechanism includes:

a rocker shaft attached to the banks, and arranged in parallel with the camshaft;

a first arm driving any one of the intake valve and the exhaust valve, and swingably supported by the rocker shaft;

a second arm swingable with the rocker shaft side as the fulcrum, and abutting against the cam to be driven via the cam;

a support shaft arranged in the vicinity of the rocker shaft;

a third arm swingably supported by the support shaft, receiving a displacement of the second arm, and further, varying the cam in accordance with a position change of the second arm generated by movement of the fulcrum of the second arm to drive the first arm; and a variable mechanism displacing the fulcrum of the rocker shaft side of the second arm, and thereby, displacing a position of the second arm driven via the cam to a circumferential direction of the camshaft.

4. A variable valve unit for a V-type engine according to claim 1, wherein the inversion mechanism is a planetary gear mechanism coaxially attached to the camshaft of said one bank.

5. A variable valve unit for a V-type engine according to claim 4, wherein the planetary gear mechanism includes a ring gear that receives a rotation of a crankshaft, a sun gear connected the camshaft of said one bank, and a carrier fixed to a cylinder head.

6. A variable valve unit for a V-type engine, comprising:

a camshaft attached to each of a pair of banks, and formed with a cam;

a rocker arm mechanism opening and closing at least one of an intake valve and an exhaust valve, and driven by the cam formed in the camshaft, and adapted to change a phase of the intake valve or the exhaust valve while displacing a position driven by the cam to a circumferential direction of the camshaft; and an inversion mechanism inverting a rotating direction of a camshaft of one bank with respect to a rotating direction of a camshaft of the other bank, wherein the rocker arm mechanism includes:

a rocker shaft attached to the banks, and arranged in parallel with the camshaft;

a first arm driving any one of the intake valve and the exhaust valve, and swingably supported by the rocker shaft;

a second arm swingable with the rocker shaft side as the fulcrum, and abutting against the cam to be driven via the cam;

a support shaft arranged in the vicinity of the rocker shaft;

a third arm swingably supported by the support shaft, receiving a displacement of the second arm, and further, varying a cam in accordance with a position change of the second arm generated by movement of the fulcrum of the second arm to drive the first arm; and a variable mechanism displacing the fulcrum of the rocker shaft side of the second arm, and thereby, displacing a position of the second arm driven via the cam to a circumferential direction of the camshaft.

7. A variable valve unit for a V-type engine, comprising:

a camshaft attached to each of a pair of banks, and formed with a cam;

a rocker arm mechanism opening and closing at least one of an intake valve and an exhaust valve, and driven by the cam formed in the camshaft, and adapted to change a phase of the intake valve or the exhaust valve while displacing a position driven by the cam to a circumferential direction of the camshaft; and an inversion mechanism inverting a rotating direction of a camshaft of one bank with respect to a rotating direction of a camshaft of the other bank, wherein the inversion mechanism is provided between a cam sprocket attached to the camshaft and a cam nearest to the cam sprocket.

8. A variable valve unit for a V-type engine comprising:

a camshaft attached to intake and exhaust sides of a pair of banks;

a rocker arm mechanism driven by the cam formed in the camshaft, and opening and closing at least one of an intake valve and an exhaust valve, and adapted to change a phase of the intake valve or the exhaust valve while displacing a position driven by the cam to a circumferential direction of the camshaft;

a first sprocket attached to a first camshaft of one bank;

a second sprocket attached to a second camshaft of said one bank;

a third sprocket attached to a third camshaft of an other bank;

a fourth camshaft mounted in said other bank;

a belt that directly transmits rotation of a crankshaft only to said first sprocket, said second sprocket, and said third sprocket; and an inversion mechanism attached to the fourth camshaft and connected to the third sprocket, such that only the fourth camshaft rotates in a direction reverse to a rotating direction of the first camshaft, the second camshaft, and the third camshaft.

9. A variable valve unit for a V-type engine according to claim 8, wherein the inversion mechanism includes a first gear attached to the third sprocket, and a second gear attached to the fourth camshaft and in direct engagement with the first gear.

* * * * *